US009957713B2

(12) United States Patent
Dixon et al.

(10) Patent No.: US 9,957,713 B2
(45) **Date of Patent: *May 1, 2018**

(54) LOAD TRANSFER DEVICE

(71) Applicant: Composite Technologies Corporation, Boone, IA (US)

(72) Inventors: Darryl Dixon, Boone, IA (US); Venkatesh Seshappa, Ames, IA (US); Robert T. Long, Sr., Ames, IA (US); Craig Van Brocklin, Story City, IA (US)

(73) Assignee: Composite Technologies Corporation, Boone, IA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/399,246

(22) Filed: Jan. 5, 2017

(65) Prior Publication Data

US 2017/0114539 A1 Apr. 27, 2017

Related U.S. Application Data

(63) Continuation-in-part of application No. 14/791,773, filed on Jul. 6, 2015, which is a continuation of (Continued)

(51) Int. Cl.
*E04C 2/04* (2006.01)
*E04B 1/61* (2006.01)

(Continued)

(52) U.S. Cl.
CPC ..... *E04C 2/044* (2013.01); *E04B 1/612* (2013.01); *E04C 2/288* (2013.01); *E04C 2/526* (2013.01);

(Continued)

(58) Field of Classification Search
CPC .... E04C 2/044; E04C 2/228; E04C 2002/046; E04B 1/612; E04B 2103/02

(Continued)

(56) References Cited

U.S. PATENT DOCUMENTS 1,053,231 A * 2/1913 Schweikert ..... 411/82
1,183,593 A * 5/1916 Robinson ..... E04B 2/86 52/426

(Continued)

FOREIGN PATENT DOCUMENTS

| | | |
|---|---|---|
| DE | 102014213769 | 1/2016 |
| EP | 2166178 | 3/2010 |
| WO | 02-25023 | 3/2002 |

OTHER PUBLICATIONS

International Search Report and Written Opinion of the International Searching Authority Covering PCT/US2017/012327 dated Oct. 9, 2017.

*Primary Examiner* — Charles A Fox
*Assistant Examiner* — Joseph J. Sadlon
(74) *Attorney, Agent, or Firm* — Brick Gentry PC; Brian J. Laurenzo; Jessica L. Susie

(57) ABSTRACT

A retention housing for receiving at least one load transfer member is provided. In some embodiments, the retention housing and load transfer member may be included in a sandwich wall panel or a double wall panel. The load transfer member may transfer loads between first and second concrete elements. The retention housing may include first and second retention members, at least one guide member, and a size indicator for aligning the retention members with respect to each other. The guide member may retain the load transfer member at a predetermined angle. In some embodiments, the size indicator may correspond to the thickness of an insulation layer, such as in a sandwich wall panel. The retention housing may further include at least one depth (Continued)

locating means. A retention housing including first and second retention members may further include means for connecting the first and second retention members, such as in an aligned position.

7 Claims, 20 Drawing Sheets

Related U.S. Application Data application No. 14/291,651, filed on May 30, 2014, now Pat. No. 9,074,370, which is a continuation of application No. 13/468,167, filed on May 10, 2012, now Pat. No. 8,839,580.

(60) Provisional application No. 61/484,966, filed on May 11, 2011.

(51) Int. Cl.
*E04C 2/288* (2006.01)
*E04C 2/52* (2006.01)

(52) U.S. Cl.
CPC ..... *E04B 2103/02* (2013.01); *E04C 2002/046* (2013.01)

(58) Field of Classification Search
USPC ..... 52/591.1
See application file for complete search history.

(56) References Cited

U.S. PATENT DOCUMENTS 3,218,774 A * 11/1965 McNiel ..... E04C 2/044 249/152
4,001,986 A * 1/1977 Kozak ..... E04B 1/04 52/236.3
4,805,366 A 2/1989 Long
5,758,461 A * 6/1998 McManus ..... E04B 1/12 52/271
7,685,789 B2 * 3/2010 Houben ..... B65D 1/243 52/323
8,276,339 B2 * 10/2012 Von Limburg ..... B28B 23/028 52/418
8,276,340 B2 * 10/2012 Meilleur ..... E04B 2/8635 52/419
8,499,514 B2 * 8/2013 Farrell, Jr. ..... E04B 2/845 52/371
8,628,717 B2 * 1/2014 Pook ..... B29C 70/443 264/510
2006/0185291 A1 * 8/2006 Mathe ..... E04B 2/8617 52/426
2010/0071305 A1 * 3/2010 Collins ..... E04B 1/24 52/704
2015/0167303 A1 6/2015 Foderberg
2015/0322673 A1 11/2015 Long, Sr.

* cited by examiner 2 inch

LOAD TRANSFER DEVICE

CROSS-REFERENCE TO RELATED APPLICATIONS

This application is a continuation-in-part of U.S. Nonprovisional patent application Ser. No. 14/791,773 filed on Jul. 6, 2015, the entire disclosure of which is hereby incorporated by reference. Application Ser. No. 14/791,773 is a continuation of U.S. Nonprovisional patent application Ser. No. 14/291,651 filed on May 30, 2014, which issued as U.S. Pat. No. 9,074,370 on Jul. 7, 2015, the entire disclosures of which are hereby incorporated by reference. Application Ser. No. 14/291,651 is a continuation of U.S. Nonprovisional patent application Ser. No. 13/468,167, filed on May 10, 2012, which issued as U.S. Pat. No. 8,839,580 on Sep. 23, 2014, the entire disclosures of which are hereby incorporated by reference. U.S. Nonprovisional patent application Ser. No. 13/468,167 claims priority from U.S. Provisional Patent Application Ser. No. 61/484,966, filed May 11, 2011, entitled X-SHAPED LOAD TRANSFER DEVICE, the contents of which is hereby incorporated in its entirety by reference.

FIELD OF THE INVENTION

This application relates generally to connectors and load transfer devices for interconnecting components, such as pavement or the structural components of a building, including the concrete wythes and insulation of a concrete sandwich wall panel or double wall panel, roof and floor members, balconies, canopies, and other insulated connections.

BACKGROUND

Sandwich wall panels, also called integrally insulated concrete panels, are well known in the construction industry. Most sandwich panels are composed of interior and exterior concrete layers, called wythes, and one or more insulation layers between the two concrete layers. The insulation layer is generally rigid insulation, such as expanded or extruded polystyrene or polyisocyanurate. Also included in the sandwich wall panel are connectors that connect the two concrete wythes through the layer(s) of insulation. The connectors hold the components of the sandwich wall panel together and also provide a mechanism whereby loads can be transferred between the components of the wall and the structure's foundation. Accordingly, a connector may also be a load transfer device. Common loads include tension, shear, and moments induced by wind, gravity, and seismic loads, as well as combinations thereof. Sandwich wall panels may have composite structural behavior or noncomposite structural behavior. In composite and partially composite sandwich wall panels, connectors must cause the two concrete wythes to function together as one structure. Depending on the application, load transfer devices may be many different shapes and composed of many different materials. One material in particular, metal, has been used in the past, but metal has undesirable thermal connectivity properties and may suffer corrosion in some situations. These problems can also be present in sandwich panels containing metal trusses or reinforcing.

Alternatively, non-composite insulated concrete sandwich walls allow the components of the sandwich wall to work independently of each other. Generally, there is a structural concrete wythe, an insulation layer, and an architectural, exterior wythe. The independent behavior eliminates problems associated with large temperature differentials between interior and exterior wythes and the thermal bowing that can be present in some structural composite panels.

Sandwich wall panels can be manufactured in a variety of ways known in the art. The entire panel may be manufactured in a plant and transported to a job site, a process known as plant precast. The panel may be constructed on the ground at the job-site and then tilted up and into place, a process known as site-cast tilt-up. Sandwich walls may also be vertically cast in place at the job site, commonly known as cast-in-place construction or vertically cast in a precast factory as part of the individual rooms of a building, a method commonly known as modular precast construction. Accordingly, the panels may be constructed in both a vertical and horizontal manner.

Also known in the industry are double wall panels, which can provide weight and structural connection improvements over traditional sandwich panels. In addition to interior and exterior concrete wythes and an insulation layer, a double wall panel also includes an air void, which may be called an air gap. Oftentimes, the air void is filled with concrete and/or additional insulation materials or another material upon delivery to the job site. Because double wall panels are typically lighter than sandwich panels, double wall panels may cost less to manufacture and ship. Because of these advantages, double wall panels may be manufactured to a larger size prior to shipment.

Sandwich and double wall panels may reduce the energy requirements of buildings and are becoming more popular as energy conservation is a growing concern among building owners and is increasingly present in construction codes. Integration of thicker insulation can provide even higher energy savings. Sustainable building construction is also gaining in popularity. Sandwich panels can provide means for sustainable construction by providing structural composite panels, increasing the thickness of the insulation, and reducing wythe thickness.

Green roofs are known in the industry and are growing in popularity. In this application, the roof slab should be insulated and provide a watertight surface. Oftentimes, these issues are addressed by including a layer of insulation between two concrete layers. Additionally, floor slabs present many of the same issues. The load transfer devices connecting the components of the roof and floor slabs must transfer the necessary loads and be thermally non-conductive so as to prevent condensation on the roof and floor slabs.

As is known in the art, sandwich wall panels may be constructed either horizontally or vertically. When constructed horizontally, a first concrete layer is poured, and the insulation layer is placed on top of the wet concrete layer. The insulation layer is designed to receive the connectors or ties that will be used to interconnect the components, usually having precut or pre-machined holes. Connectors of the prior art are often designed to be placed between side-by-side sections of insulation, leaving behind gaps in the insulation layer that must be filled with another insulation. Sandwich panels that are constructed vertically are often constructed using a method known as "cast-in-place". In this method, the walls are created at their service location. Vertical forms are erected, and the insulation and connectors are placed into the vertical forms. The vertical forms are open at the top. Both layers of concrete are then poured simultaneously into the top of the forms. Alternatively, the concrete may be pumped into the form from one or more openings near the bottom. Accordingly, the concrete surrounds the insulation as in the horizontal methods of manufacture.

Connectors of the prior art are often connected to internal reinforcing, which makes installation difficult. Accordingly, connectors that do not require connection to reinforcing or use of trusses in the wall panel and, therefore, provide ease of assembly and installation, are preferred. In addition, it can be advantageous to use a load transfer device that is composed of discrete load transfer members that can be selectively positioned as the application requires. Such a load transfer device should provide for simple and cost-effective handling and transport and be easy to install.

Accordingly, a load transfer device has been provided in U.S. patent application Ser. Nos. 14/791,773; 14/291,651; and 13/468,167 and U.S. Pat. Nos. 9,074,370 and 8,839,580, the disclosures of which are all incorporated by reference in their entireties, that is also a shear connector which can be used in all methods of manufacturing concrete sandwich and double wall panels, including vertical, horizontal, and modular methods, as well as in other applications where it is desired to connect concrete. The aforementioned shear connector provides increased strength and load transfer properties over the prior art. The connector is thermally nonconductive. Further, the connector can reduce or eliminate the need to include trusses that span the insulation layer. The connector can provide a standoff or spacing function during the manufacture of double wall panels. Further, the connector holds the concrete wythes of the panel from shifting during handling and transport. The connector may be handled and transported easily, as the components of the connector may be efficiently packed and used for many different projects. Moreover, the connector may be quickly and efficiently installed. The load transfer device provides superior shear transfer capacity and can be placed easily in both rigid and non-rigid insulation material.

Optionally provided with the aforementioned connector is a retention housing. Said retention housing is preferably made of foam to fit in cavities in the insulation layer of a sandwich wall panel. Furthermore, the retention housing receives and retains the load transfer device, which in some embodiments is an individual load transfer member, as described in the aforementioned patents and applications. Preferably, the retention housing retains the load transfer device at the proper orientation in the sandwich panel, such as at the proper angle. The previously-disclosed retention housing may work in cooperation with a depth locator, which locates the load transfer device at the proper depth. Moreover, the previously-disclosed retention housing is designed such that each retention housing is manufactured for a single thickness of insulation. Needed in the art, however, is a retention housing which can be adjusted for a variety of insulation thicknesses in the sandwich wall panel. The retention housing may be a rotationally symmetrical single part, which would lower manufacturing, inventory, and shopping costs, along with lessening confusion of the end user in the field. In addition, the retention housing should also be capable of use in applications that do not include insulation. Moreover, such a retention housing may include depth locating means to locate the load transfer device at its appropriate depth, in addition to its appropriate angle. The retention housing may be made from plastic, which is more durable, less expensive, and easier and safer to manufacture than the foam retention housings of the previously-discussed applications and patents.

SUMMARY

Accordingly, provided is a retention housing for a load transfer member. In one embodiment, a retention housing is combined with a load transfer member connecting a first concrete element to a second concrete element. An insulation layer may be located between the first and second concrete elements. Moreover, the retention housing may be received by the insulation layer. The retention housing may include at least one guide member to retain the load transfer member at a predetermined angle. The load transfer member may comprise a first end that extends into the first concrete element and a second end that extends into the second concrete element.

In addition, the retention housing may include at least one depth locating means, such as a depth locating tab. The load transfer member may include an indentation or bulge which receives the depth locating tab. In some embodiments, the retention housing may comprise a first retention member and a second retention member. Moreover, the first and second retention members may include a size indicator for aligning the first and second retention members with respect to each other. The size indicator may correspond to the thickness of the insulation layer. Specifically, the size indicator may be on a front surface or top lip of the first and second retention members. In addition, the retention housing may include a top, and the angle may be between twenty and seventy degrees, such as forty-five to sixty degrees, from the normal of said top.

In another embodiment, a retention housing for receiving at least one load transfer member is provided, wherein the load transfer member transfers loads between first and second concrete elements. The retention housing comprises first and second retention members, at least one guide member, and a size indicator. The guide member retains the load transfer member at a predetermined angle. The size indicator may align the first and second retention members with respect to each other. The retention housing may further include a depth locating means, such as depth locating tab. In addition, the retention members may include a front surface or a top lip which includes the size indicator for aligning the first and second retention members with respect to each other. The retention housing may include a top and the angle may be between twenty and seventy degrees, such as forty-five to sixty degrees, from the normal of the top. Moreover, in some embodiments, the retention housing may be capable of receiving two load transfer members.

In yet another embodiment, a sandwich wall panel is provided which comprises a first concrete layer, second concrete layer, an insulation layer located between the first and second concrete layers, at least one load transfer member, and at least one retention housing receiving the load transfer member. The retention housing may include first and second retention members. It may further include at least one guide member to retain the load transfer member at a predetermined angle. Moreover, at least one of the first and second retention members may include a size indicator for aligning the first and second retention members with respect to each other. In some embodiments, the size indicator may correspond to the thickness of the insulation layer. Moreover, the sandwich wall panel may include two load transfer members which are received by the retention housing. The retention housing may further comprise at least one depth locating means. The insulation layer may receive the retention housing. In another embodiment, a double wall panel is provided which also includes an air gap between the insulation layer and one of the first and second concrete layers and wherein the size indicator may correspond to the thickness of both the insulation and the air gap layers.

In yet another embodiment, a retention housing for receiving at least one load transfer member is provided wherein the load transfer member transfers loads between first and second concrete elements. The retention housing includes first and second retention members and at least one guide member to retain the load transfer member at a predetermined angle. At least one of the first and second retention members includes a size indicator for aligning the first and second retention members with respect to each other in an aligned position. Moreover, the retention housing includes means for connecting the first and second retention member in the aligned position. The retention members may further include at least one tab which may be removed in the aligned position, such as a plurality of tabs, a portion of which are removed in the aligned position and wherein the remaining portion creates a thermal break.

The first and second retention members may be identical and/or adjustable. Moreover, the size indicator for aligning the first and second retention members with respect to each other may correspond to a plurality of sizes of the retention housing. At least one of the first and second retention members may include a projection, and at least one of the first and second retention members may include a slot. The slot may receive the projection to connect the first and second retention members in the aligned position. Furthermore, at least one of the first and second retention members may include at least one of a top and bottom lip, such as a bottom lip which is tapered.

DETAILED DESCRIPTION

Figure 1:
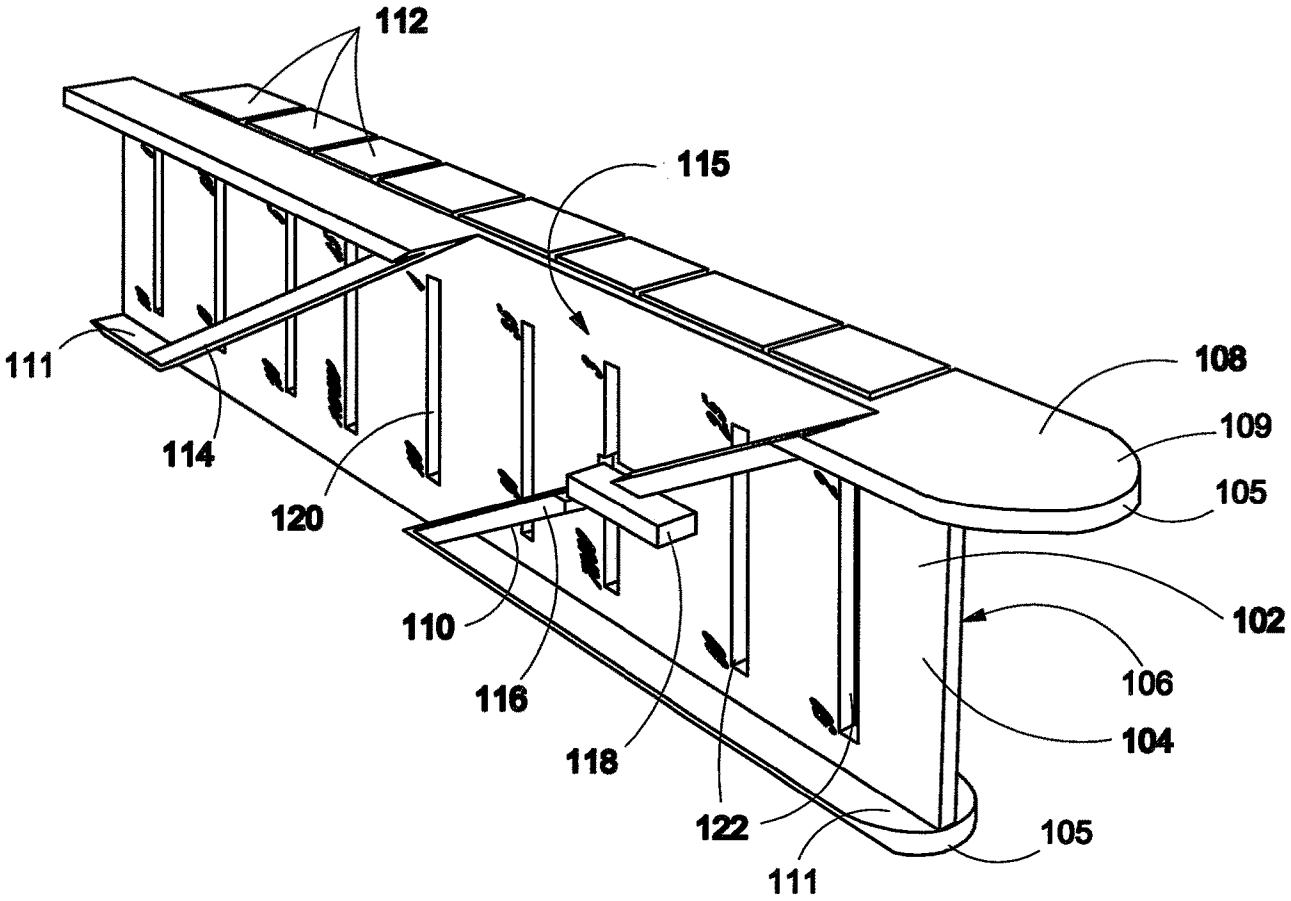
FIG. 1 is a perspective view of an embodiment of a retention member of the present invention.
Figure 1A:
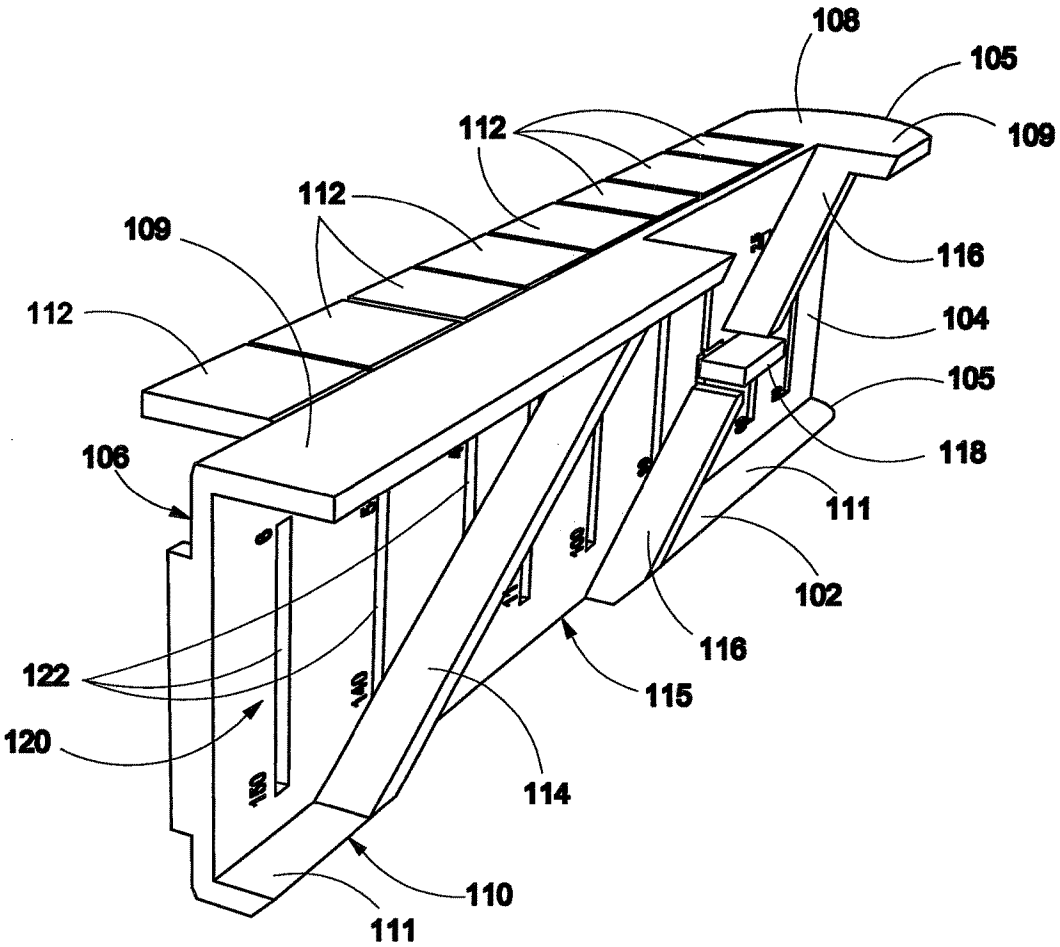
FIG. 1A is a perspective view of the front and top of the retention member of FIG. 1.

The following is a detailed description of an embodiment of an improved retention housing 100 for use with a load transfer device. An example of a load transfer device is described in detail in U.S. patent application Nos. Ser. Nos. 14/791,773; 14/291,651; and Ser. No. 13/468,167 and U.S. Pat. Nos. 9,074,370 and 8,839,580, the disclosures of which are all hereby incorporated by reference in their entireties, although a retention housing 100 of the present invention may be used with any type of load transfer device. An embodiment of a retention housing is disclosed and described in detail in the above-referenced applications and patents. The embodiments of retention housings of the present invention provide improved features and may be used in combination with the load transfer device of the above-referenced applications and patents or other load transfer devices, known now or in the future. The retention housing 100 of the present invention may be used in conjunction with load transfer devices that connect concrete elements in any type of application. Examples include, but are not limited to, sandwich wall panels, balconies, roofs, and bridge decks. In some applications, the retention housing 100 will be used in applications including insulation, such as a sandwich wall panel having two concrete wythes and a layer of insulation there between. The description below will generally describe the preferred embodiment of the retention housing 100 for use with sandwich wall panels. However, it should be understood that the description is not limiting, and the retention housing may be used for a variety of applications, including those that do not include insulation. Moreover, the retention housing 100 will generally be described for use with the load transfer device of the aforementioned patents and applications, which include two load transfer members. However, it should be understood that this example is not limiting, and the retention housing 100 of the present invention may be used with one or more of any load transfer device.

The retention housing 100 of the present invention may retain a load transfer device at its proper position with respect to the concrete elements it connects. The retention housing of the present invention is preferably made of plastic; however, the retention housing may be made of other suitable materials, as will be recognized by one of skill in the art. Further, the retention housing may be manufactured in any number of pieces, including one complete retention housing or two or more retention members. Preferably the retention housing 100 is composed of two retention members 102. Turning to FIGS. 1, 1A, 1B, and 2, the preferred embodiment of a retention member 102 of the present invention is shown. As will be discussed in further detail below, preferably two identical retention members 102 are connected to produce the preferred retention housing (shown in FIG. 3). One of skill in the art will recognize that the retention housing 100 may be made of any number of retention members or pieces, including one, two, or more. In embodiments having two retention housings 102, the retention members are preferably identical.

Figure 1B:
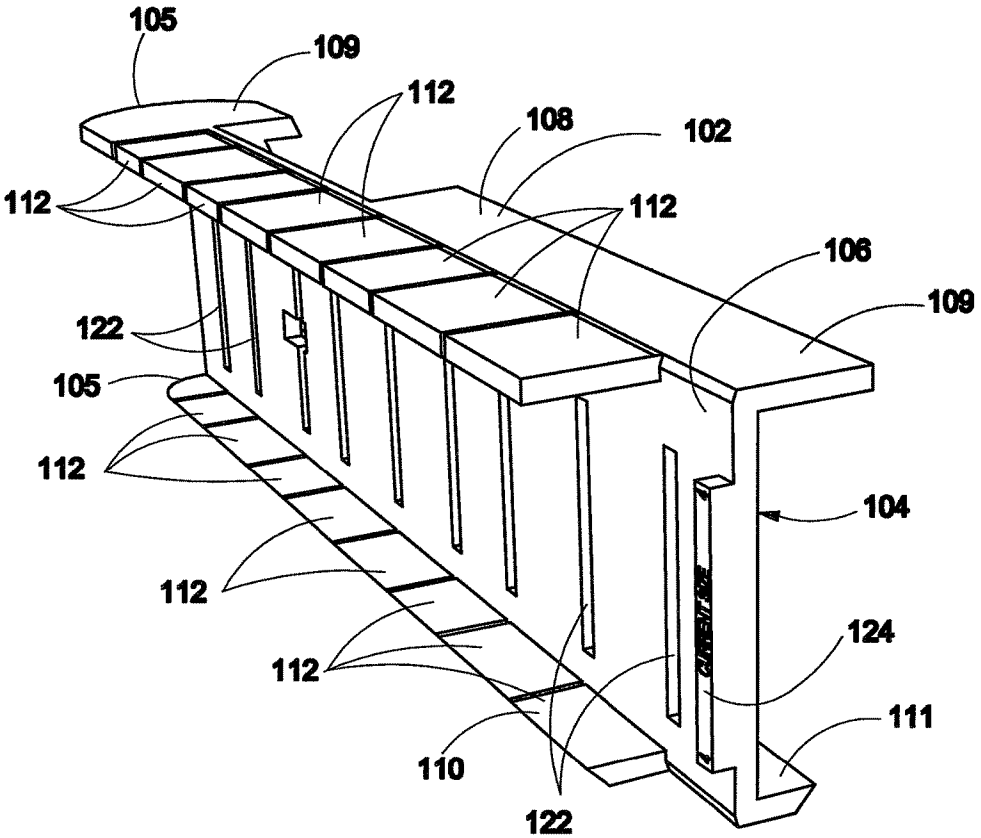
FIG. 1B is a perspective view of the back and top of the retention member of FIG. 1.
Figure 3:
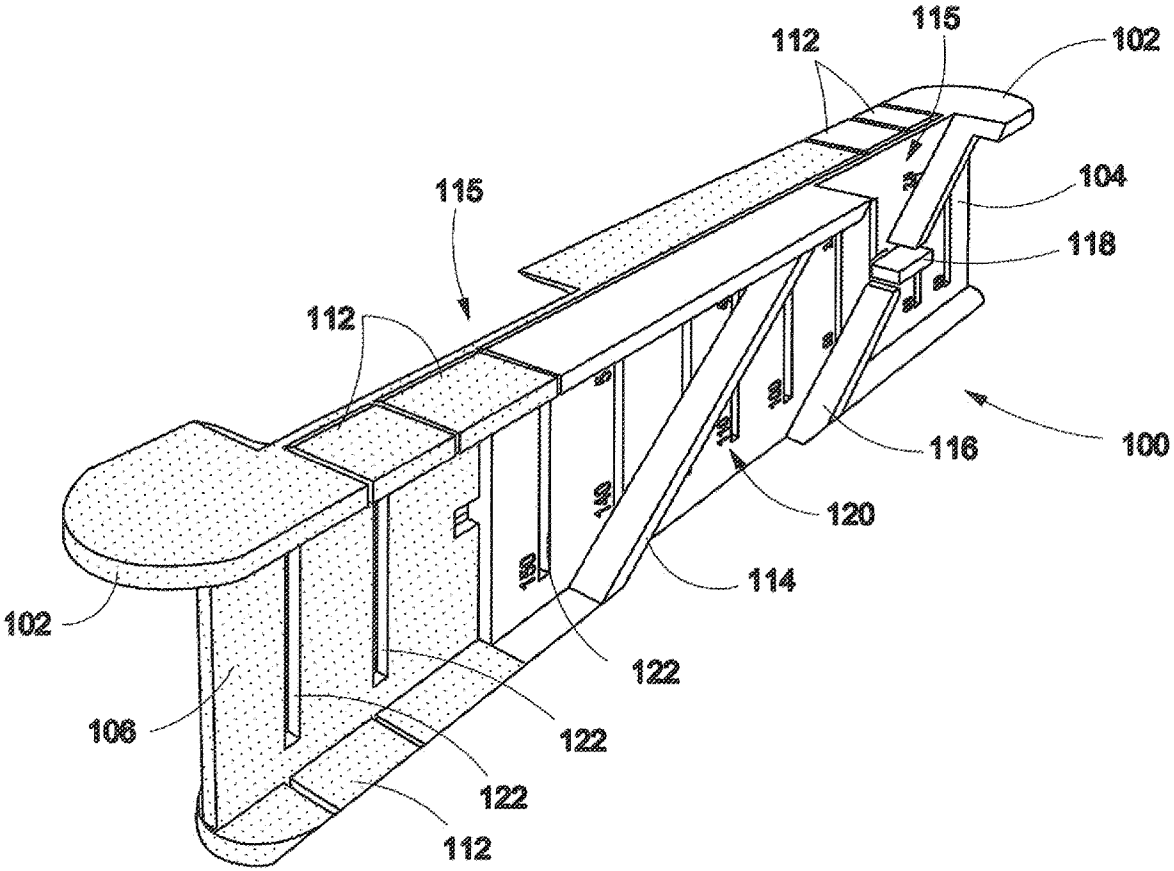
FIG. 3 is a perspective view of a retention housing having two retention members of FIG. 1.
Figure 4:
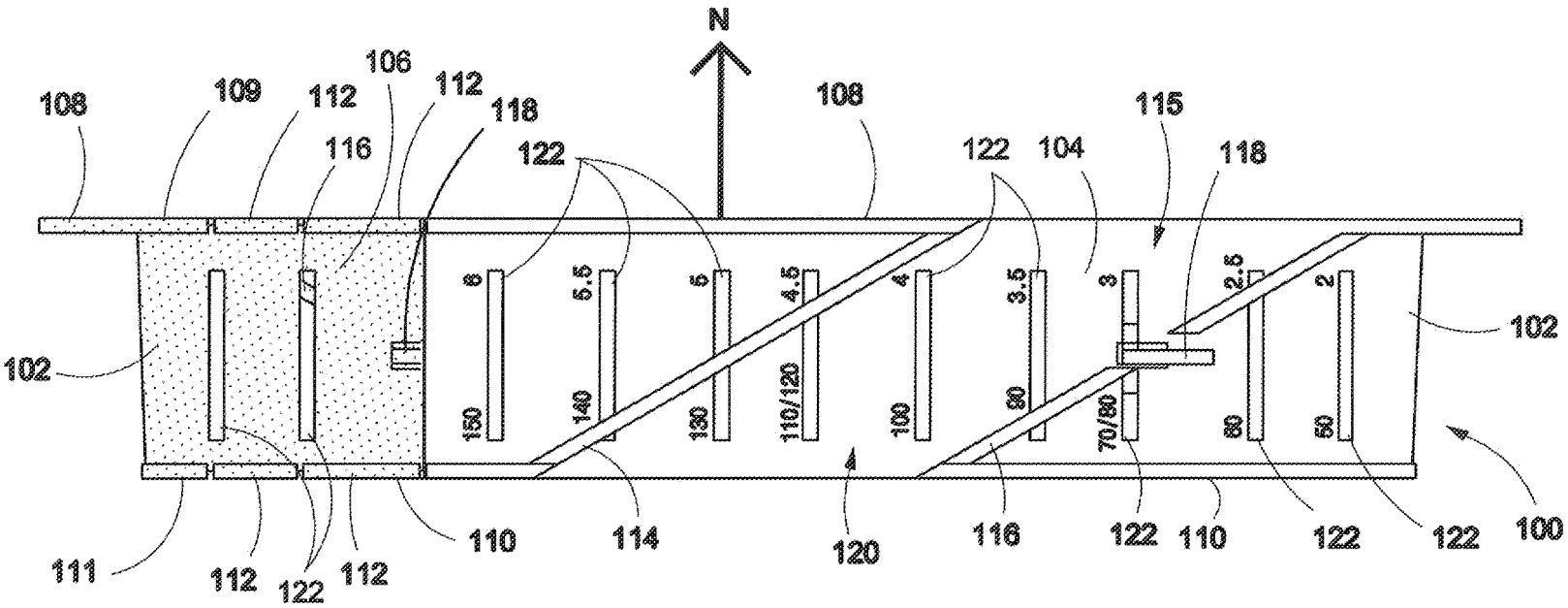
FIG. 4 is a front elevation view of the retention housing of FIG. 3.

The retention member 102 includes a front surface 104, back surface 106 (shown in FIGS. 1A, 1B, 3 and 4), top 108, top lip 109, bottom 110, and bottom lip 111. The lips 109, 111 create an air void between the lips and within the insulation layers which creates a thermal break. Preferably the top lip 109 is bigger than the bottom lip 111. The bottom lip 111 is fit into a cavity in the insulation layer. The top lip 109 overlaps the insulation to hold the retention housing 100 in place and for proper depth. Accordingly, the retention housing 100 is held flush with the insulation layer and steady while load transfer members 126 are inserted, as described below. In some embodiments, the user may chamfer or design the bottom lip 111 to assist in seating. Moreover, a bigger top lip 109 than bottom lip 111 also helps the user orient the retention housing 100 properly in the sandwich panel. The top 108 and bottom 111 include a plurality of tabs 112 (bottom tabs are shown in FIGS. 1B, 3, and 4). As will be discussed in detail below, the tabs 112 are removable to fit the retention members 102, and accordingly retention housing 100, to varying thicknesses of insulation in a sandwich wall panel. The retention housing 100 also includes bottom rounded edges 105 which are rounded to correspond to the often-used tooling used to cut cavities in an insulation layer which will accept the retention housing 100, such as a round router bit. The top rounded edges 105 also allow the retention housing 100 to sit on the insulation layer which assists with depth location.

Further shown on FIGS. 1, 1A, 3, and 4 are a first guide member 114 and a second guide member 116. The guide members 114, 116 guide and retain a load transfer member to its proper position. Between the guide members 114 is a recess 115. A depth locating 118 tab receives an indentation 128 on the load transfer device to position a load transfer member at its proper depth, as will be discussed and shown in detail below. As one of skill in the art will recognize, this arrangement may be reversed. Namely, the load transfer member may include a tab which is accepted by an indentation on the retention member 102. Moreover, a different configuration entirely may be used to position the load transfer member at its appropriate depth.

Figure 2:
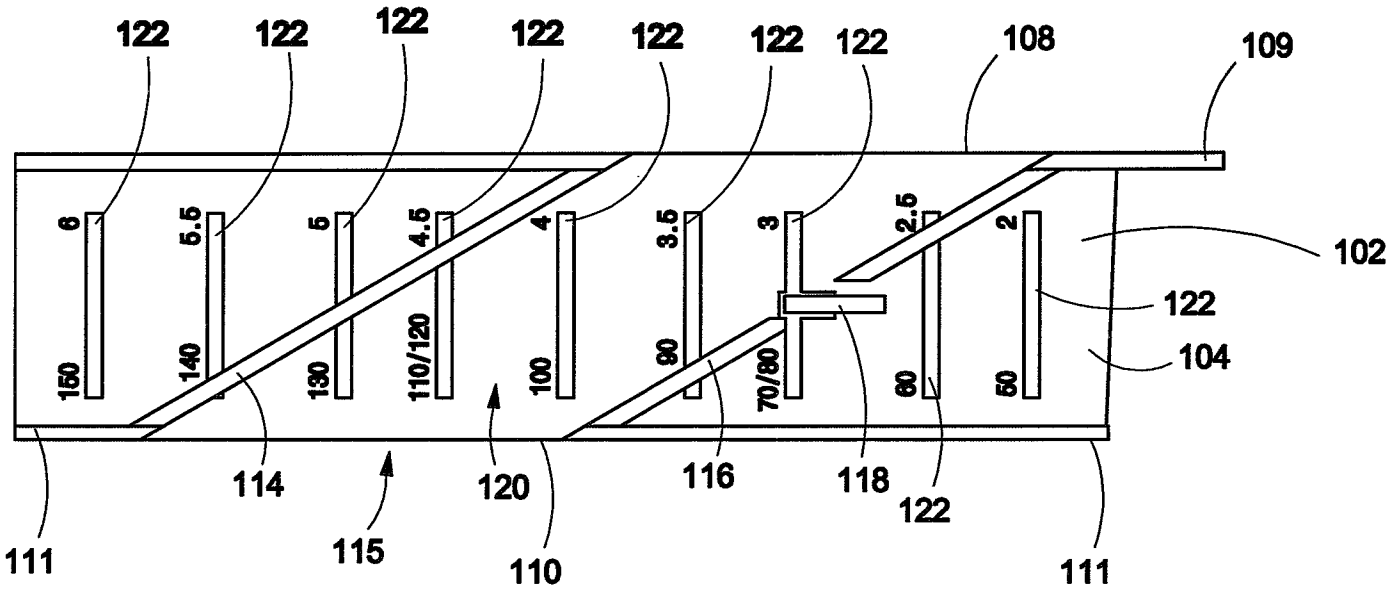
FIG. 2 is a front elevation view of the retention member of FIG. 1.

The front surface 104 includes an optional size indicator 120. The size indicator 120 may be used to align two retention members 102 with respect to each other. As shown in FIGS. 1 and 2, the size indicator 120 includes numbers which correspond to common thicknesses of an insulation layer in a sandwich wall panel—for example, the illustrated size indicator 120 includes positions for thicknesses of 2, 2.5, 3, 3.5, 4, 4.5, 5, 5.5, and 6 inches, as well as 50, 60, 70, 80, 90, 100, 110, 120, 130, 140, and 150 millimeters. As will be clear to one skilled in the art, the retention members 102 and size indicator 120 may be designed to accommodate any thickness of insulation. The size indicator 120 may also correspond to the thickness of an air gap, such as in the case of a double wall panel, or both insulation and an air gap combined. Moreover, in embodiments wherein the retention housing 100 will not be used with insulation, the size indicator 120 may correspond to a different measurement or the size indicator 120 may be disregarded or not included at all. In addition, an indicator may be used which corresponds to something other than size. Furthermore, associated with each entry of the size indicator 120 is a slot 122. As discussed in further detail below, the slots 122 are used to connect the retention members 102 to create the retention housing 100.

Moving now to FIG. 3, a retention housing 100 of the present invention is shown. The retention housing includes two retention members 102, which are arranged such that the back surfaces 106 face each other. Each retention member 102 includes tabs 112, a first guide member 114, second guide member 116, recess 115, depth locating tab 118, size indicator 120, and slots 122. FIG. 3 shows the front surface 104 of the front retention member 102. The front surface 104 of the back retention member 102 faces in the opposite direction. It is not seen in FIG. 3, but is identical to the shown front surface 104. The back surface 106 of the back retention member 120 is shown in FIG. 3. In this configuration, the recesses 115 form an "X" shape, as will be discussed below.

Figure 5:
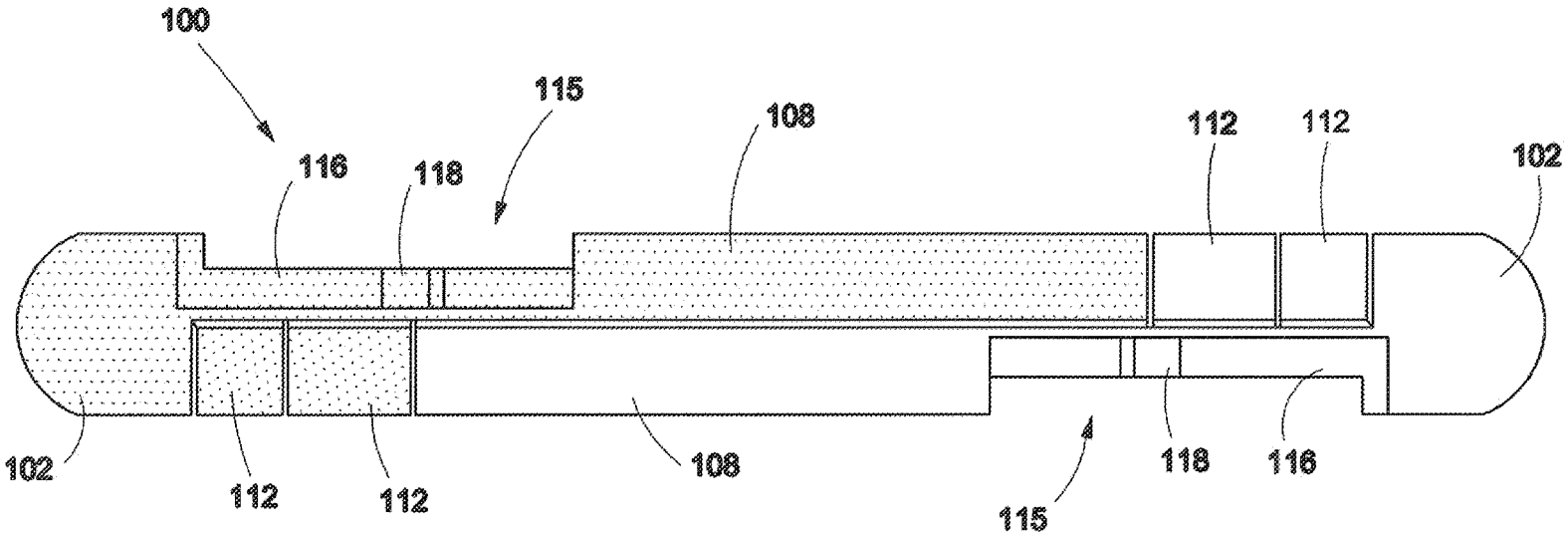
FIG. 5 is a top view of the retention housing of FIG. 3

Furthermore, FIGS. 4 and 5 provide further views of the retention housing 100. Specifically, FIG. 4 is a front elevation view of a retention housing 100 of the present invention. Shown are two retention members 102, which have been connected via slots 122 and projections 124 (shown in FIGS. 1B, 6, and 7). The back surface 106 of the back retention member 102 is illustrated, as is the top 108 and bottom 110 of back retention member 102. Tabs 112 are located along both the top 108 and bottom 110. Also shown are two slots 122 and the back of the depth locating tab 118. A small portion of the second guide member 116 is visible through a slot 122. The front retention member 102 also includes a top 108 and bottom 110. Although the front retention member 102 includes tabs 112, they are not shown in this view (but are shown in FIG. 5). The front face 104 includes the size indicator 120, slots 122, first guide member 114, second guide member 116, recess 115, and depth locating tab 118.

FIG. 5 is a top view of a retention housing 100 of the present invention. In this view, one of the two retention members 102 is shaded to distinguish the two retention members 102 from each other. Illustrated is the top 108 of both retention members 102, including the tabs 112 which remain after connection, which will be discussed in detail below. The recess 115 of each retention member 102 reveals the second guide member 116 and depth locating tab 118.

Figure 6:
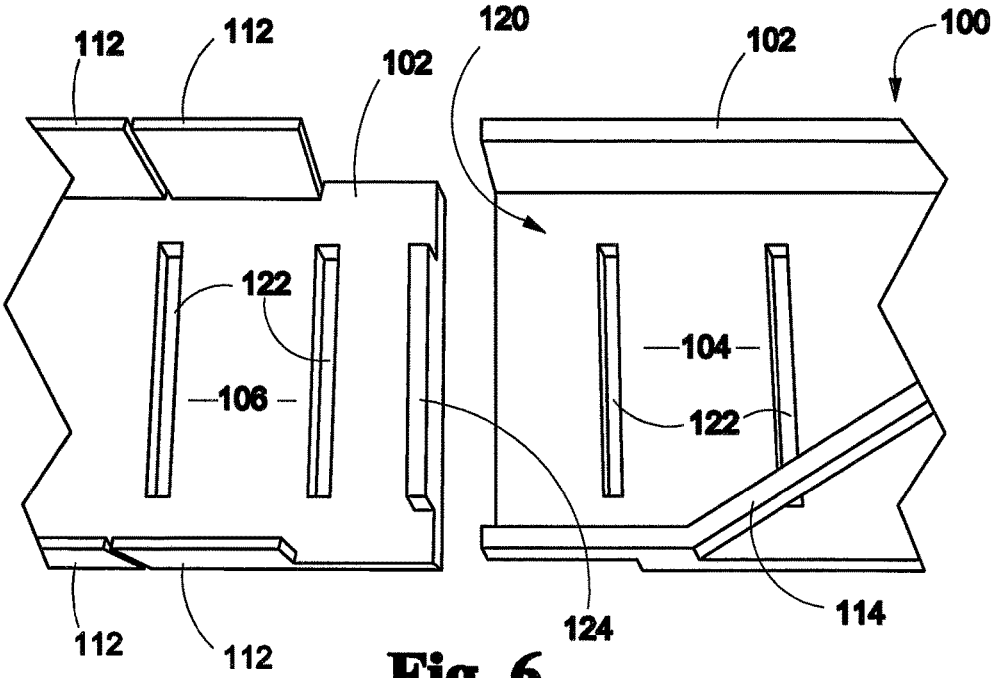
FIG. 6 is a perspective view of the ends of two retention members of FIG. 1.
Figure 7:
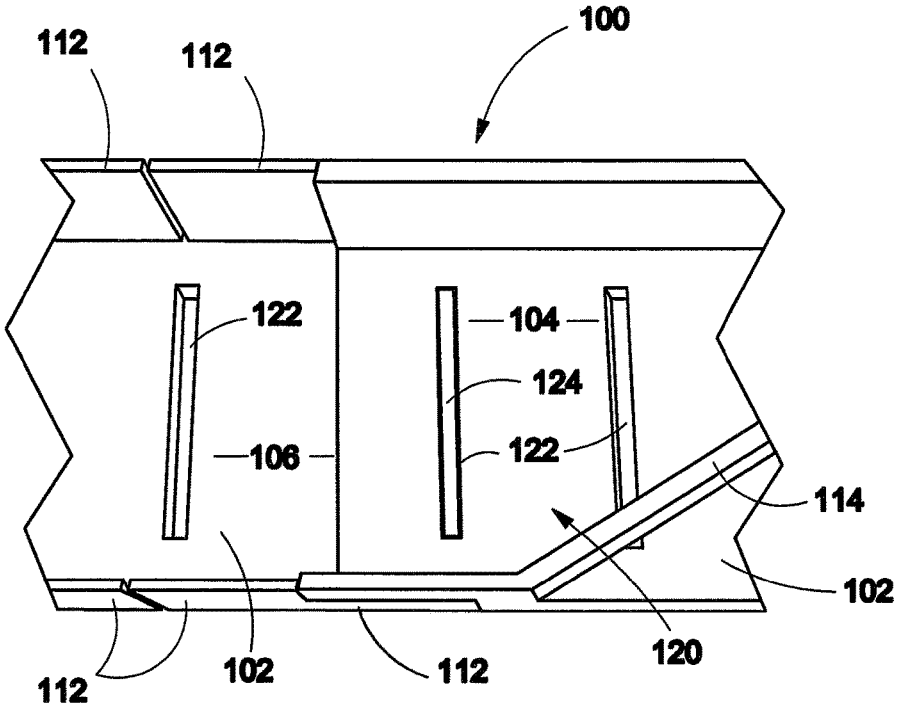
FIG. 7 is a perspective view of the two retention members of FIG. 6 connected into a retention housing.

To create a retention housing, two retention members 102 are connected via two of the plurality of slots 122 and two projections 124, with only the front connection shown in FIG. 6. In FIG. 6, the projection 124 on the left retention member 102 is visible. The user chooses the slot 122 which corresponds to the appropriate thickness of insulation on the size indicator 120. The projection 124 is then inserted into the designated slot 122. At the same time, the projection 124 (not shown) on the right retention member 102 inserts into the corresponding slot of the left retention member 102. However, depending on the thickness of the insulation, one or more tabs 112 may prevent the slots 122 and projections 124 from connecting. Accordingly, the tabs 112, are removable. The user may remove the tabs 112 necessary to allow the retention members 102 to fit together as needed for the application. In the preferred embodiment, the user can simply break away the excess tabs 112. Comparing FIGS. 1, 1A, and 1B with FIG. 3, FIGS. 1, 1A, and 1B show a number of tabs 112 which have been removed in FIG. 3 to allow the two retention members to fit together. Next, turning to FIG. 7, the projection 124 has been received by the slot 122, thus connecting the two retention members 102 into one retention housing 100.

Figure 8:
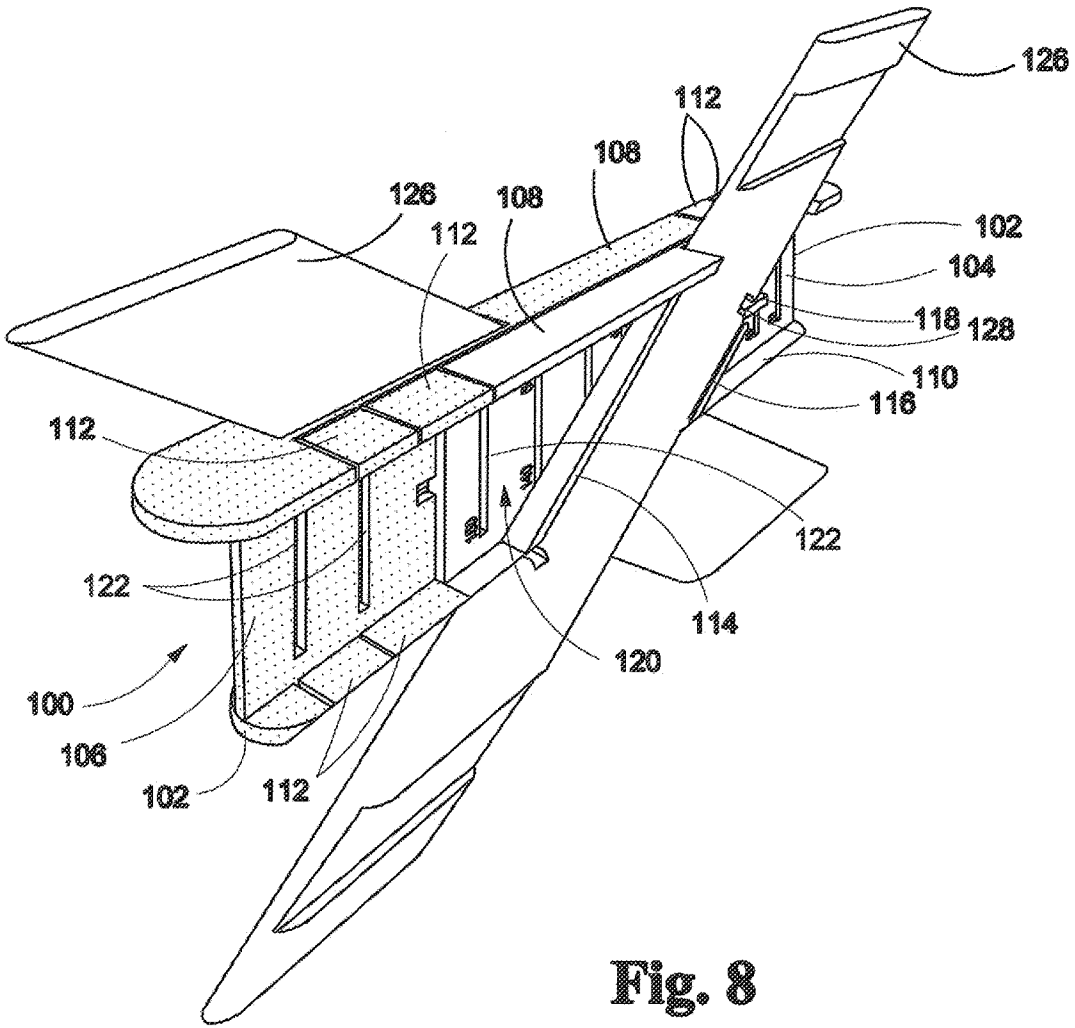
FIG. 8 is a perspective view of the retention housing of FIG. 3 housing two load transfer members.

Moving to FIG. 8, the retention housing 100 is shown including further components of a load transfer device.

Specifically, the illustrated load transfer device includes two load transfer members 126, which are described in detail in U.S. patent application Ser. Nos. 14/791,773; 14/291,651; and 13/468,167 and U.S. Pat. Nos. 9,074,370 and 8,839,580, the disclosures of which are all hereby incorporated by reference in their entireties. As noted above, the retention housing 100 preferably includes two retention members 102 which receive two load transfer members 126—one load transfer member 126 per retention member 102. However, in embodiments wherein one load transfer member 126 is employed, the retention housing 100 may include a single retention member 102. The two retention members each include a top 108 and bottom 110. Located along both the top and bottom are tabs 112 (also seen in FIG. 1B), which may be removed to connect the two retention members 102. The front surface 104 of the front retention member is shown, while the back surface 106 of the back retention member is shown. The size indicator 120 of the front retention member 102 is located on the front surface 104. The first guide member 114 and second guide member 116 guide and retain each load transfer member 126 at its proper angle. The angle may be, but is not limited to, from twenty to seventy degrees from the normal N of the top 108 (see FIG. 4), such as from forty-five to sixty degrees. Furthermore, the depth locating tabs 118 meet an indentation 128 on the load transfer member 126. Also shown are the slots 122, the appropriate ones of which accept the projections 124 (not shown) to size the retention housing 100.

Accordingly, to assemble a retention housing 100 with further components of a load transfer device, the user first obtains two retention members 102. Of course, a retention housing of the present invention need not include multiple retention members. However, as discussed above, the preferred embodiment includes two retention members 102, so that the retention members 102 may be assembled into retention housings 100 in a variety of sizes. The user then determines the thickness of insulation used in the wall panel. Using the size indicator 120, the user determines which slots 122 will accept the projections 124. The user then breaks off the tabs 112 necessary to allow the two retention members 102 to fit together and inserts the projections 124 into the slots 122. The remaining tabs 112 prevent concrete from getting into the retention housing 100. Next, the user obtains the illustrated load transfer members 126. However, any type, number, or shape of load transfer devices may be used without departing from the scope of the invention. The load transfer members 126 are inserted into the recesses 115 of the two retention members using the first guide member 114 and second guide member 116 to guide the load transfer members 126 into place. The load transfer members 126 are inserted until the indentation 128 of the load transfer member 126 accepts the depth locating tab 118. At that point, the load transfer members 126 are positioned at the correct angle and depth for the application. In the preferred embodiment, the two load transfer members 126 cross to form an "X" shape, which is facilitated by the recesses 115 and guide members 114, 116. However, the load transfer members 126 need not cross or may cross at a location other than their centers, as will be appreciated by one of skill in the art and often depend on the application.

It is anticipated that assembly of the retention housing 100 and load transfer device may take place in the field or at a precast manufacturing facility. The retention members 102 need not be assembled prior to shipping, but might be in some circumstances. Moreover, it is anticipated that the load transfer members 126 will be inserted after the retention housing 100 has been inserted into the insulation. The retention housing 100 may be held in the insulation via friction or other methods.

The retention members 102 are preferably identical. As shown in FIGS. 3-5, 7, and 8, the two identical retention members 102 face in opposite directions, such that their back surfaces 106 are next to each other. The first guide members 114, second guide members 116, and recesses 115 face in opposite directions. When assembled, the two recesses 115 are X-shaped and cross each other rather than being parallel to each other. However, depending on the application, the configuration of the recesses 115 may differ from the described embodiment. Preferably, the recesses 115 are identical so that they may accept identical load transfer members 126, leading to increased versatility.

Preferably, the retention housing 100 is made of plastic, although it may be made of any material suitable for the application. Plastic provides some advantages over retention members made of insulating material, wherein many retention members are generally cut from one sheet of foam insulation. Cutting foam insulation includes safety hazards for manufacturers and is slow and expensive. In addition, foam insulation is bulky to ship and the foam is easily damaged. Moreover, the retention members made of foam insulation are lightweight and may be difficult to contain in the plant or at the jobsite. The plastic retention members, while lightweight, do not present the same obstacles. Moreover, in many situations, the plastic retention members are less expensive to manufacture than retention members made of foam insulation. Nevertheless, if a retention housing made of insulation is preferred, a rigid insulation material, including, but not limited to, expanded or extruded polystyrene, polyisocyanurate, and high density rockwool, may be used.

Figure 9:
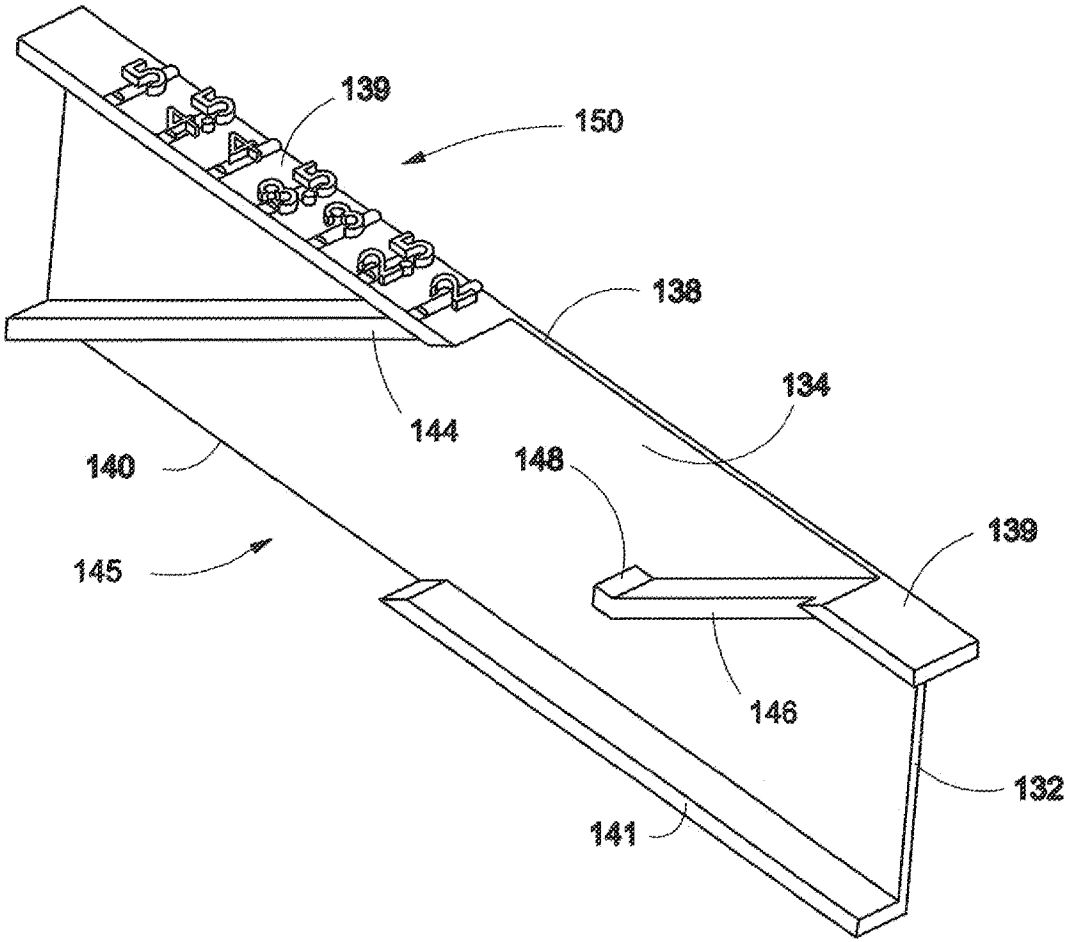
FIG. 9 is a perspective view of a second embodiment of a retention member of the present invention.
Figure 12:
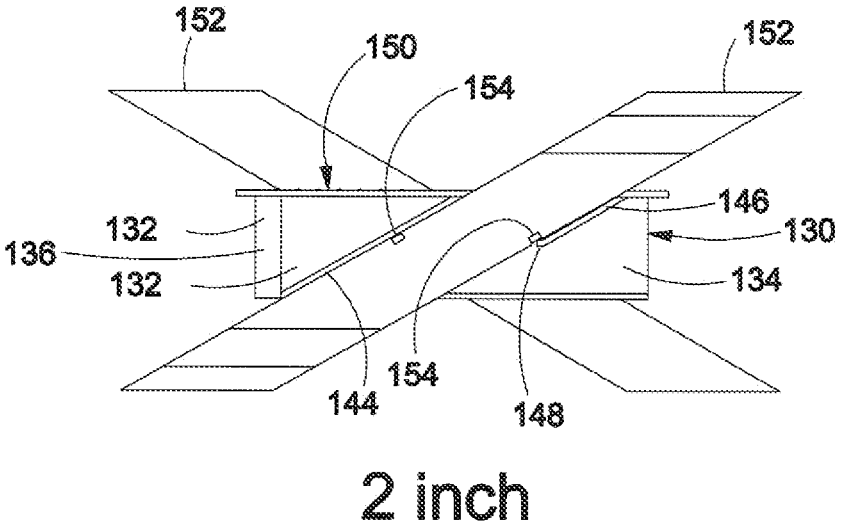
FIG. 12 is a front elevation view of a first embodiment of a load transfer device including two retention members of FIG. 9 configured for a panel including two inches of insulation.
Figure 13:
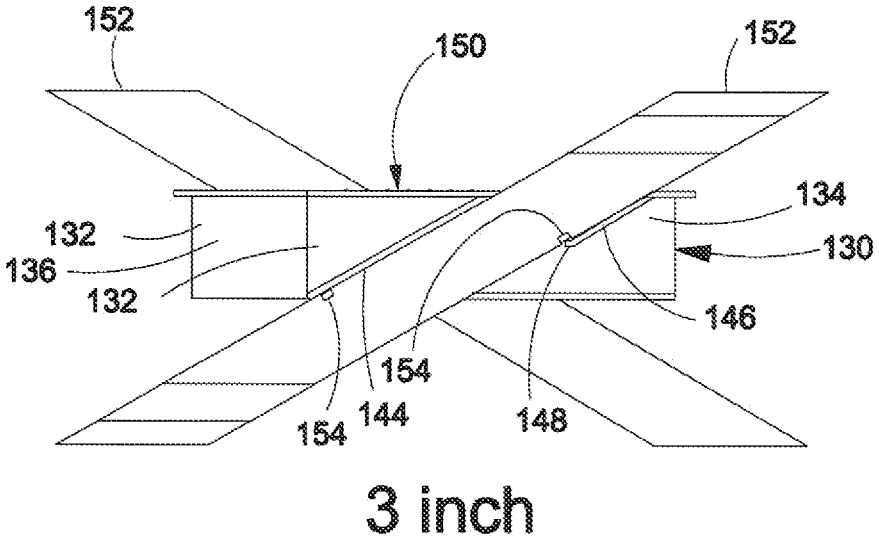
FIG. 13 is a front elevation view of a second embodiment of a load transfer device including two retention members of FIG. 9 configured for a panel including three inches of insulation.
Figure 14:
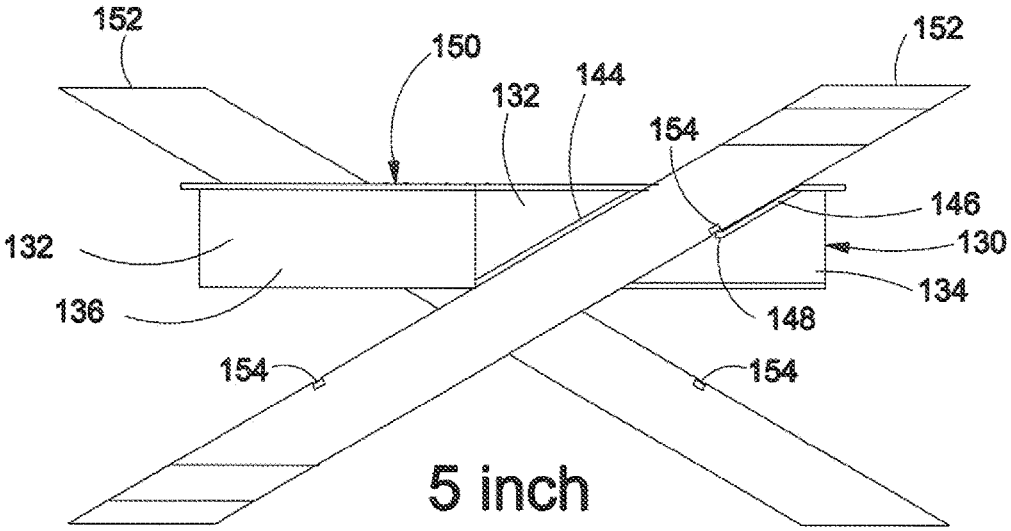
FIG. 14 is a front elevation view of a second embodiment of a load transfer device including two retention members of FIG. 9 configured for a panel including five inches of insulation.

Turning to FIG. 9, a second embodiment of a retention member 132 is shown. The retention member 132 includes a front surface 134, top 138, and bottom 140. The top 138 may include at least one top lip 139. In the illustrated embodiment, two top lips 139 are shown. The bottom 140 may include at least one bottom lip 141. The retention member 132 also includes a back surface 136, which is not shown in FIG. 9. Further included is a recessed portion 145 to receive a load transfer device, which is preferably a load transfer member (not shown in FIG. 9) as discussed above. The recessed portion 145 is at least partially bordered by a first guide member 144 and a second guide member 146. The guide members 144, 146 guide the load transfer member to its correct position and retain the load transfer member at a predetermined angle. The retention member 132 may include at least one depth locating means. In the illustrated embodiment, the retention member 132 includes a depth locating tab 148. As will be discussed and shown in further detail below, the load transfer member may include an indentation to assist with positioning the load transfer member at its proper depth. Specifically, an indentation may receive the depth locating tab 148 to provide a stop when the load transfer member is at its appropriate depth, which is best shown in FIGS. 12-14. The tab 148 may be somewhat flexible or spring-like to aid in insertion of the load transfer member. Of course, one of skill in the art will recognize that other depth locating means may be used or that the load transfer device of the present invention may be used without depth locating means. For example, in an alternative embodiment, the load transfer members may include a bulge which assists with positioning the load transfer member at its proper depth. The bulge may be received by an indentation in one of the retention members 132. The retention member also includes a size indicator 150, which may be used to align two retention members 132 to create a second embodiment of a retention housing 130.

Figure 10:
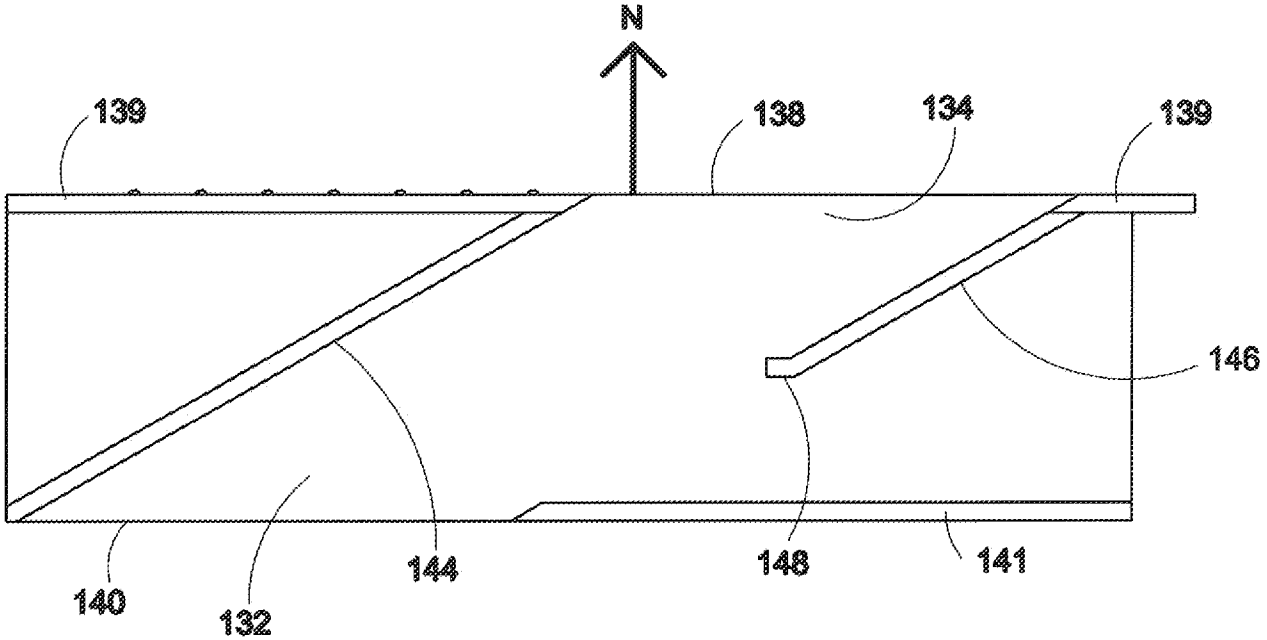
FIG. 10 is a front elevation view of the retention member of FIG. 9.
Figure 11:
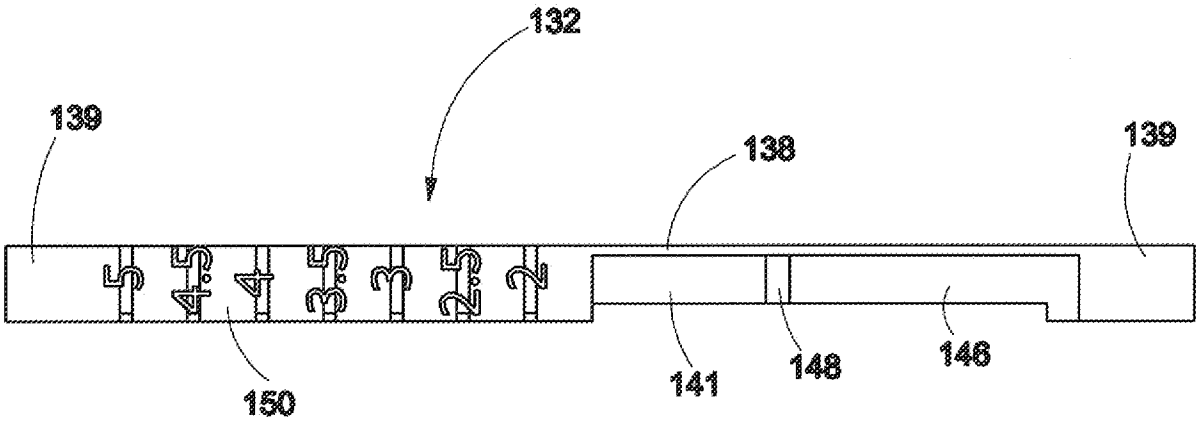
FIG. 11 is a top elevation view of the retention member of FIG. 9.

Turning to FIG. 10, a front elevation view of the retention member 132 is provided. Shown are the top 138, bottom 140, front surface 134, top lips 139, and bottom lip 141. As discussed above, the guide members 144, 146 help guide the load transfer member into position, such as at a predetermined angle. Specifically, the guide members 144, 146 may position the load transfer member at its appropriate angle. In one embodiment, the angle of the load transfer member may be 60 degrees from the normal N of the top 138 of the retention housing 132. However, as one of skill in the art will appreciate, any angle appropriate for the application may be used. Accordingly, the guide members 144, 146 in combination with the depth locating tab 148 may position the load transfer member at its proper angle and depth. The size indicator 150 is shown in further detail in FIG. 11, which is a top elevation view of the second embodiment of the retention housing 132. The size indicator 150 corresponds to various thicknesses of insulation, as discussed below.

Accordingly, to assemble a retention housing 130 for a load transfer device, the user first obtains two retention members 132. Of course, a retention housing of the present invention need not include multiple retention members. However, the preferred second embodiment includes two retention members 132 so that the retention members 132 may be assembled into retention housings 130 in a variety of sizes. Moreover, in the preferred second embodiment, each retention member 132 corresponds to one load transfer member. The user then determines the thickness of insulation used in the wall panel. Using the size indicator 150, the user determines where to align the retention members with respect to each other. Any type, number, or shape of load transfer members may be used without departing from the scope of the invention. The load transfer members 152 are inserted into the recesses 145 of the two retention members using the first guide member 144 and second guide member 146 to guide the load transfer members 152 into place. The load transfer members 152 are inserted until the indentation 154 of the load transfer member 152 accepts the depth locating tab 148. At that point, the load transfer members 152 are positioned at the correct angle and depth for the application. It is anticipated that assembly of the retention housing 130 and load transfer device may take place in the field or at a precast manufacturing facility. The retention members 132 may be assembled prior to shipping but need not be. Moreover, it is anticipated that the load transfer members 152 will be inserted after the retention housing 130 has been inserted into the insulation. The retention housing 130 may be held in the insulation via friction or other methods.

Figure 15:
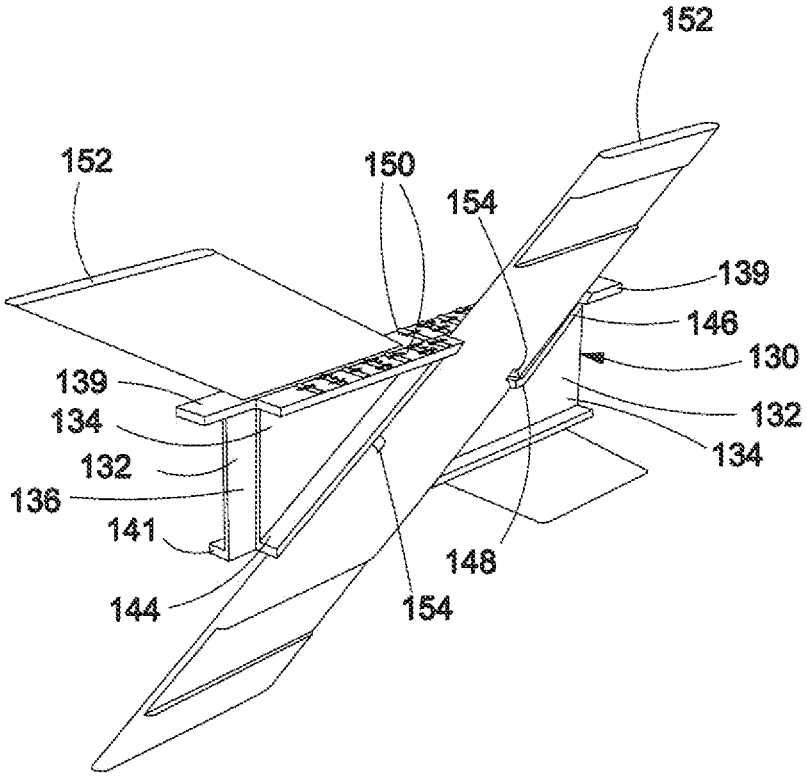
FIG. 15 is a perspective view of the embodiment of the load transfer device shown in FIG. 12.
Figure 16:
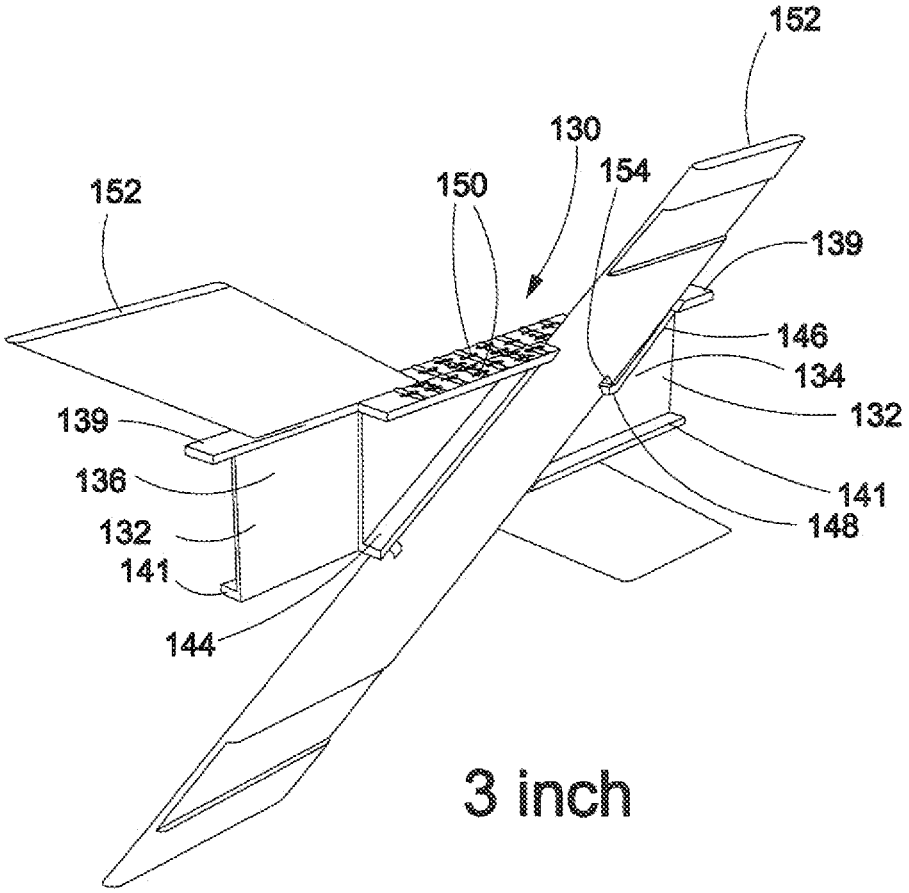
FIG. 16 is a perspective view of the embodiment of the load transfer device shown in FIG. 13.
Figure 17:
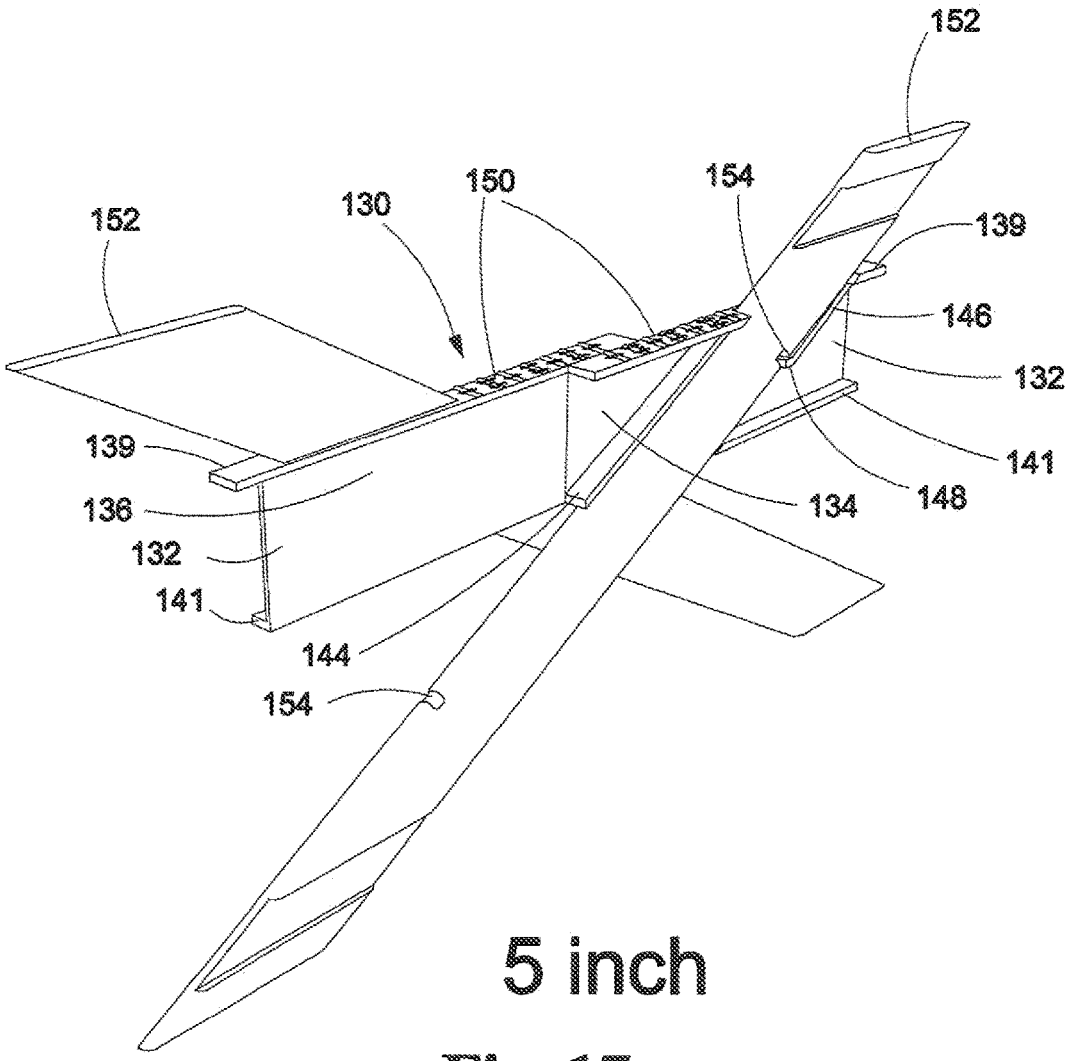
FIG. 17 is a perspective view of the embodiment of the load transfer device shown in FIG. 14.

As with the preferred embodiment of the retention housing 100 discussed above, the second embodiment of the retention housing 130 may be used to retain any load transfer device in any application. In the illustrated second embodiment, the retention housing 130 is used in association with the load transfer device of U.S. patent application Ser. Nos. 14/791,773; 14/291,651; and 13/468,167 and U.S. Pat. Nos. 9,074,370 and 8,839,580, the disclosures of which are all hereby incorporated by reference in their entireties. In most embodiments, two retention members 132 will be used to retain two load transfer members in place. FIGS. 12-14 illustrate embodiments of the retention housing 130 including the retention members 132 for various thicknesses of insulation—2 inches in FIG. 12, 3 inches in FIG. 13, and 5 inches in FIG. 14. The same retention members 132 may be used for all three embodiments. Comparing the three embodiments, the length of the load transfer members 152 may change if desired; however, using the size indicator 150 of the retention members 132, the same retention members 132 can be used for all three embodiments. The retention members 132 retain the load transfer members 152 at the same angle in each of the three embodiments. The load transfer members 152 may cross near their center in all lengths, but it is not necessary for the retention members 132 to be located at that center, as illustrated in FIG. 14. Accordingly, the retention members 132 are versatile and may be used for many applications, including wall panels with varying thicknesses, including varying thicknesses of insulation. Moreover, the size indicator 150 aids in positioning the load transfer device in each application. Specifically, the user simply aligns the numbers corresponding to the thickness of the insulation, as shown in FIGS. 15-17.

Retention members of the present invention, including both the first embodiment 102 and second embodiment 132, and retention housings 100, 130 constructed therefrom, present advantages at jobsites. Load transfer devices including the retention members 102 or 132 can be easily added to an existing project without the need for customized parts. Because the retention members 102 or 132 are universal and may be used for many insulation and/or air gap thicknesses, users may use the retention members 102 or 132 for many different projects, for example if excess retention members 102 or 132 are left over from a previous project. The retention members 102 or 132 are easily adaptable to new or existing projects and can be easily designed and installed in such projects. Moreover, the same retention members 102 or 132 may be used in different areas of the same building that require different sizing. Moreover, the plastic inserts easily into the insulation layer for assembly of a wall panel. In addition, the load transfer members slide easily into the plastic retention members and reliably lock into place at the proper depth.

The retention housing 100 or 130 uses universal, preferably identical parts that are preferably mirrors of each other rather than requiring two or more distinct parts, which results in decreased manufacturing, handling, and transport costs, such as less inventory and shipping. Accordingly, the retention housing 100 or 130 is adjustable. Moreover, the plastic retention housing 100 or 130 is much more durable than the foam retention housings in the aforementioned patents and applications. The retention housings 100 or 130 of the present application may be used and adjusted with a variety of insulation thicknesses without needing new parts. One assembly can be used with a variety of transfer members and insulation thicknesses.

Figure 18:
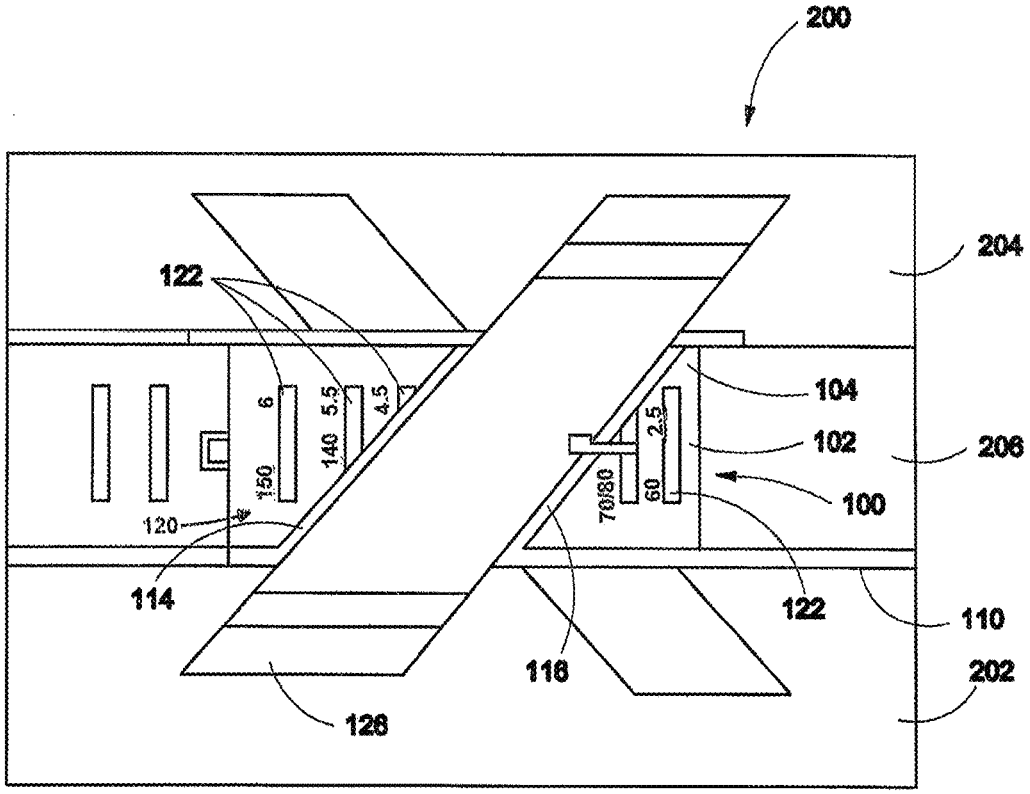
FIG. 18 is a side elevation view of a section of a sandwich wall panel according to one embodiment of a sandwich wall panel of the present invention.
Figure 19:
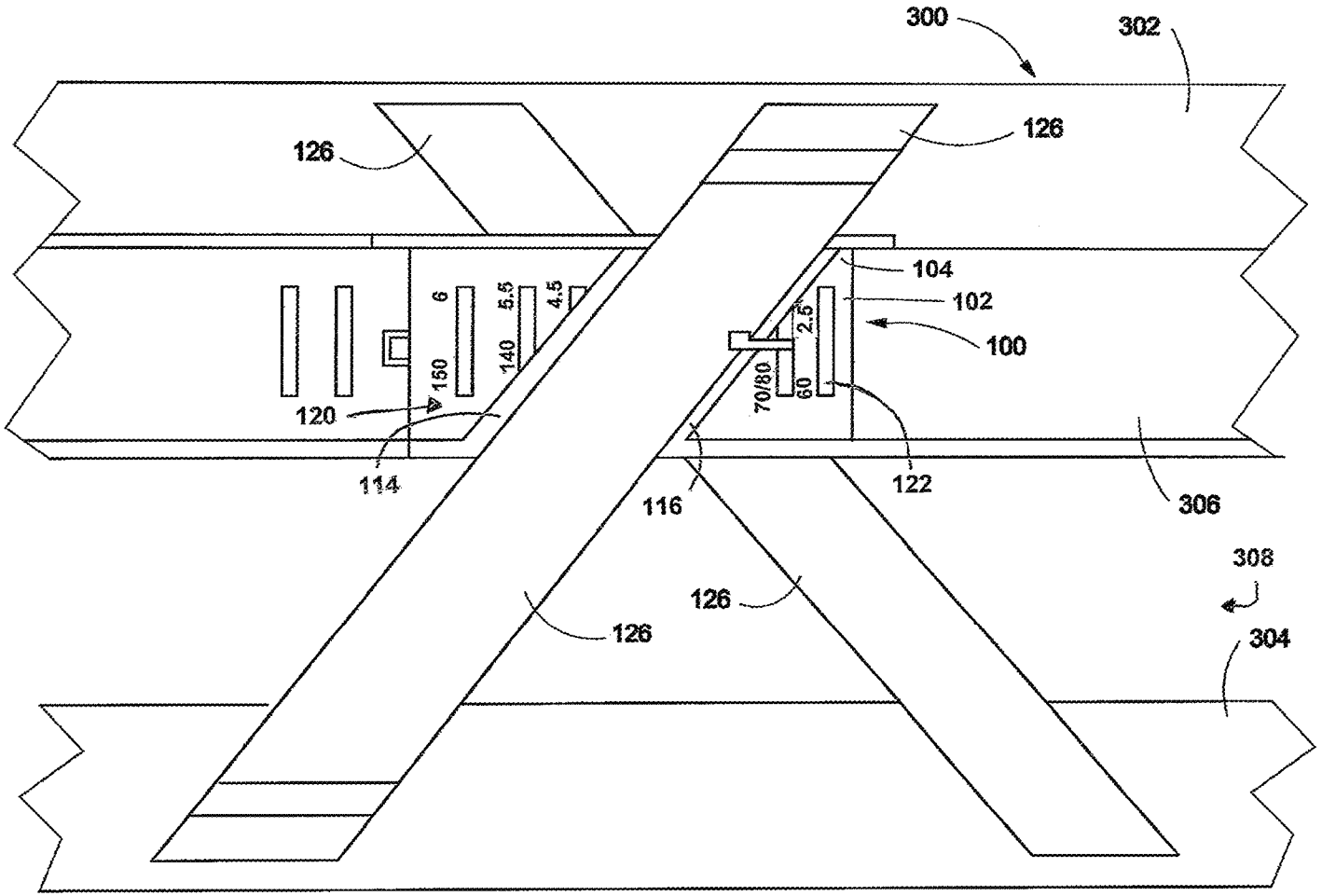
FIG. 19 is a side elevation view of a section of a double wall panel according to one embodiment of a double wall panel of the present invention.

Also provided in the present invention are sandwich wall panels, double wall panels, and methods of manufacturing same wherein the wall panels employ a retention housing of the present invention, as discussed below (a sandwich wall panel and a double wall panel are shown in FIGS. 18 and 19, respectively). Such a sandwich wall panel may be constructed as described in detail in U.S. patent application Ser. Nos. 14/791,773; 14/291,651; and 13/468,167 and U.S. Pat. Nos. 9,074,370 and 8,839,580, the disclosures of which are all hereby incorporated by reference in their entireties. As described above, when using a retention housing of the present invention, preferably the retention housing is composed of two retention members, such as the preferred embodiment of the retention member 102 or second embodiment of the retention member 132 discussed above. The two retention members are assembled to the appropriate size as described in detail above and inserted into a cavity in an insulation panel. In some embodiments, a void may be left between the retention housing 100 or 130 and insulation layer. In such a case, if the user desires, the void may be filled with other types of insulation. Or, the void may be left empty. The sandwich wall panel and/or double wall panel may then be manufactured consistent with the detailed explanation found in U.S. patent application Ser. Nos. 14/791,773; 14/291,651; and 13/468,167 and U.S. Pat. Nos. 9,074,370 and 8,839,580. Because the retention housings 100 or 130 of the present invention are composed of identical retention members 102 or 132, they may be used in a variety of applications. For example, in addition to the illustrated embodiments, the retention housing 100 or 130 could be used in association with a single load transfer member 126 or 152 arranged in a diagonal fashion for carrying the dead load from an outside wythe to an inside wythe in some types of wall panels. Moreover, each retention member 102 or 132 is versatile and may be used in any application or orientation. Preferably, the load transfer members 126 or 152 are also identical and can be used in association with either embodiment of the retention housing. Moreover, the load transfer members 126 or 152 are also versatile, including multiple indentations 128 or 154 so that each load transfer member 126 or 152 can be used in a variety of applications.

The retention housing 100 of the present invention may be used in conjunction with one or more load transfer devices that connect concrete elements in any type of application. In some applications, the retention housing 100 will be used in applications including insulation such as a sandwich wall panel 200 having two concrete wythes and a layer of insulation there between. In one embodiment, the retention housing 100, described above, may be used with a sandwich wall panel 200, also called an integrally insulated concrete panel. An exemplary sandwich wall panel is shown in FIG. 18. Generally, three elements are present, a first concrete layer 202, a second concrete layer 204, and an insulation layer 206. Although not shown, a sandwich wall panel 200 may further include an exterior façade attached to the exterior concrete element.

The sandwich wall panel 200, illustrated in FIG. 18, includes a retention housing 100 used in conjunction with a load transfer device to connect the first concrete layer 202, second concrete layer 204, and insulation layer 206. FIG. 18 is a cross sectional view of a sandwich wall panel 200 looking at a load transfer device from the side when the sandwich wall panel 200 is in its vertical position. In FIG. 18, two load transfer members 126 are shown as having been inserted into two retention members 102 of the retention housing 100. The front surface 104 of a front retention member 102 is shown. The front retention member 102 is located on the front surface 104. In FIG. 18, a first guide member 114 and second guide member 116 guide and retain each load transfer member 126 at its proper angle. The front surface 104 further includes a size indicator 120. FIG. 18 also shows slots 122, the appropriate ones of which accept the projections 124 (not shown) to size the retention housing 100, and which are associated with the size indicator 120, as discussed above.

A double wall panel 300, such as the one shown in FIG. 19, also may employ the retention housing 100 of the present invention in conjunction with one or more load transfer devices to connect concrete elements. FIG. 19 shows an embodiment of a double wall panel 300. The version of a double wall panel 300 shown in FIG. 19 includes a first concrete layer 302, a second concrete layer 304, an insulation layer 306, and an air gap 308. The embodiment of a double wall panel 300 shown in FIG. 19 illustrates how the retention housing 100 of the present invention is used in conjunction with a load transfer device to connect the first concrete layer 302, second concrete layer 304, and insulation layer 306. In FIG. 19, two load transfer members 126 are shown as having been inserted into two retention members 102 of the retention housing 100. The load transfer members 126 include a portion that spans the first concrete element 302, a portion that spans the insulation layer 306 through the retention housing 100, a portion that spans the air void 308, and a portion that spans the second concrete element 304. In FIG. 19, a first guide member 114 and second guide member 116 guide and retain each load transfer member 126 at its proper angle. The front surface 104 further includes a size indicator 120. FIG. 19 also shows slots 122, the appropriate ones of which accept the projections 124 (not shown) to size the retention housing 100, and which are associated with the size indicator 120, as discussed above.

Although various representative embodiments of this invention have been described above with a certain degree of particularity, those skilled in the art could make numerous alterations to the disclosed embodiments without departing from the spirit or scope of the inventive subject matter set forth in the specification and claims. Joinder references (e.g. attached, adhered) are to be construed broadly and may include intermediate members between a connection of elements and relative movement between elements. As such, joinder references do not necessarily infer that two elements are directly connected and in fixed relation to each other. In some instances, in methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

Although the present invention has been described with reference to the embodiments outlined above, various alternatives, modifications, variations, improvements and/or substantial equivalents, whether known or that are or may be presently foreseen, may become apparent to those having at least ordinary skill in the art. Listing the steps of a method in a certain order does not constitute any limitation on the order of the steps of the method. Accordingly, the embodiments of the invention set forth above are intended to be illustrative, not limiting. Persons skilled in the art will recognize that changes may be made in form and detail without departing from the spirit and scope of the invention. Therefore, the invention is intended to embrace all known or earlier developed alternatives, modifications, variations, improvements, and/or substantial equivalents.

The invention claimed is:

1. A retention housing in combination with a load transfer member connecting a first concrete element to a second concrete element, an insulation layer located between said first concrete element and said second concrete element, said retention housing received by said insulation layer; said retention housing having at least one guide member to retain said load transfer member at a predetermined angle and wherein said load transfer member comprises a first end that extends into said first concrete element and a second end that extends into said second concrete element.

2. The retention housing of claim 1 further comprising at least one depth locating means.

3. The retention housing of claim 2 wherein said depth locating means comprises a depth locating tab.

4. The retention housing of claim 3 wherein said load transfer member includes an indentation which receives said depth locating tab.

5. The retention housing of claim 1 further comprising a first retention member and a second retention member.

6. The retention housing of claim 1 wherein said retention housing includes a top and wherein said guide member is positioned between twenty and seventy degrees from the normal of said top and wherein said predetermined angle is also between twenty and seventy degrees from the normal of said top.

7. The retention housing of claim 6 wherein said angle is between forty-five and sixty degrees from the normal of said top.

* * * * *